US008887440B2

(12) United States Patent
Simon

(10) Patent No.: US 8,887,440 B2
(45) Date of Patent: Nov. 18, 2014

(54) GARAGE DOOR ANTENNA

(71) Applicant: Arvin Brent Simon, Crystals Falls, MI (US)

(72) Inventor: Arvin Brent Simon, Crystals Falls, MI (US)

( * ) Notice: Subject to any disclaimer, the term of this patent is extended or adjusted under 35 U.S.C. 154(b) by 0 days.

(21) Appl. No.: 13/910,434

(22) Filed: Jun. 5, 2013

(65) Prior Publication Data

US 2013/0326956 A1 Dec. 12, 2013

Related U.S. Application Data

(60) Provisional application No. 61/656,563, filed on Jun. 7, 2012.

(51) Int. Cl.
*E05F 15/10* (2006.01)
*E05F 15/20* (2006.01)
*E05F 15/00* (2006.01)

(52) U.S. Cl.
CPC ..... *E05F 15/2023* (2013.01); *E05F 15/0073* (2013.01); *E05Y 2900/106* (2013.01); *E05Y 2900/55* (2013.01)
USPC ..... 49/28; 49/199; 340/5.71

(58) Field of Classification Search
USPC ..... 49/26, 27, 28, 197, 199; 340/5.7, 5.71, 340/572.7
See application file for complete search history.

(56) References Cited

U.S. PATENT DOCUMENTS

| | | | | |
|---|---|---|---|---|
| 4,727,679 | A * | 3/1988 | Kornbrekke et al. | 49/138 |
| 5,142,822 | A * | 9/1992 | Beckerman | 49/27 |
| 5,412,297 | A * | 5/1995 | Clark et al. | 318/468 |
| 6,457,371 | B1 | 10/2002 | Feller | |
| 6,651,385 | B2 * | 11/2003 | Miller et al. | 49/27 |
| 7,151,450 | B2 * | 12/2006 | Beggs et al. | 340/545.1 |
| 7,260,367 | B2 | 8/2007 | McMorrow et al. | |
| 2005/0174077 | A1 | 8/2005 | Haag et al. | |
| 2010/0052933 | A1 | 3/2010 | Gunton | |
| 2011/0234367 | A1 | 9/2011 | Murphy et al. | |
| 2012/0098588 | A1 | 4/2012 | Ujvari | |

* cited by examiner

*Primary Examiner* — Katherine Mitchell
*Assistant Examiner* — Catherine A Kelly
(74) *Attorney, Agent, or Firm* — Sand & Sebolt

(57) ABSTRACT

A system and method for controlling a garage door is presented. An alarm system includes an antenna mounted to a garage door. A signal generator logic generates a periodic signal based on a capacitive value of the antenna. The signal generator logic also provides transmit power to the antenna that is radiated away from the garage door. A detection logic detects if there is a change in a characteristic of the periodic signal caused by movement in proximity of the garage door. Amplification logic amplifies the change of the periodic signal. Alarm detection logic determines if the change is an alarm and an alarm response logic will stop a movement of the garage door when the change is an alarm resulting from movement near the door.

13 Claims, 17 Drawing Sheets

| | | |
|---|---|---|
| FIG-5A | FIG-5B | |
| FIG-5C | FIG-5D | |
| FIG-5E | FIG-5F | |

GARAGE DOOR ANTENNA

CROSS REFERENCE TO RELATED APPLICATION

This application claims priority from U.S. Provisional Application Ser. No. 61/656,563, filed Jun. 7, 2012; the disclosure of which is incorporated herein by reference.

BACKGROUND OF THE INVENTION

1. Field of Invention

The current invention relates generally to apparatus, systems and methods for detecting moving objects. More particularly, the apparatus, systems and methods relate to detecting moving object and opening a door. Specifically, the apparatus, systems and methods provide for detecting when an obstruction is preventing something from being opened or closed.

2. Description of Related Art

It is often desirable to open doors or other objects. For example, garage doors are often used to shelter vehicles from the weather. Remotely and electronic controls have been developed to allow a driver of a vehicle to remotely open and close a garage door without having to exit the vehicle and manually open the door. Most modern garage doors contain several sections that are hinged together to allow them to roll up and down while guided by a track assembly. In the up position a garage door can be over the vehicle and parallel to the ground. When lowered, the garage door can come down and might crush anything in its path. Something can be in the wrong position and may cause problems when opening or closing many other objects. Therefore, a better way opening or closing an opening is desired.

SUMMARY

The preferred embodiment of the invention includes a system for controlling a garage door. An alarm system includes an antenna mounted to a garage door. A signal generator logic generates a periodic signal based on a capacitive value of the antenna. The signal generator logic also provides transmit power to the antenna that is radiated away from the garage door. A detection logic detects if there is a change in a characteristic of the periodic signal caused by movement in proximity of the garage door. Amplification logic amplifies the change of the periodic signal. Alarm detection logic determines if the change is an alarm and then alarm response logic will stop movement of the garage door when the change is an alarm resulting from movement near the door.

Another configuration of the preferred embodiment is a garage door safety system. The garage door safety system includes detection logic, amplification logic, alarm generation logic and alarm response logic. The detection logic receives a first capacitance value from a first antenna mounted on a garage door and a second capacitive value from a second antenna mounted on the garage door. The detection logic generates a stream of pulses based, at least in part, on the first capacitive value and the second capacitive value as well as detecting differences between two or more of the pulses. The amplification logic amplifies the differences to produce amplified differences. The alarm generation logic determines if the amplified differences correspond to an alarm condition. If the differences produce an alarm, condition the alarm response logic changes a movement of the garage door. For example, it can stop the garage door and/or instruct it to move to an open position.

Another configuration of the preferred embodiment is a method for detecting a moving object moving with respect to a garage door. The method beings by receiving at an antenna an altered electromagnetic field altered by the moving object. The capacitance of the antenna is a capacitive element of an oscillating circuit. The method next detects if one or more pulses of the oscillating circuit are different than other pulses generated by the oscillating circuit. The difference can then be amplified. A determination is made to determine if the difference is an alarm condition. When the difference is an alarm condition the movement of the garage door is stopped.

BRIEF DESCRIPTION OF SEVERAL VIEWS OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
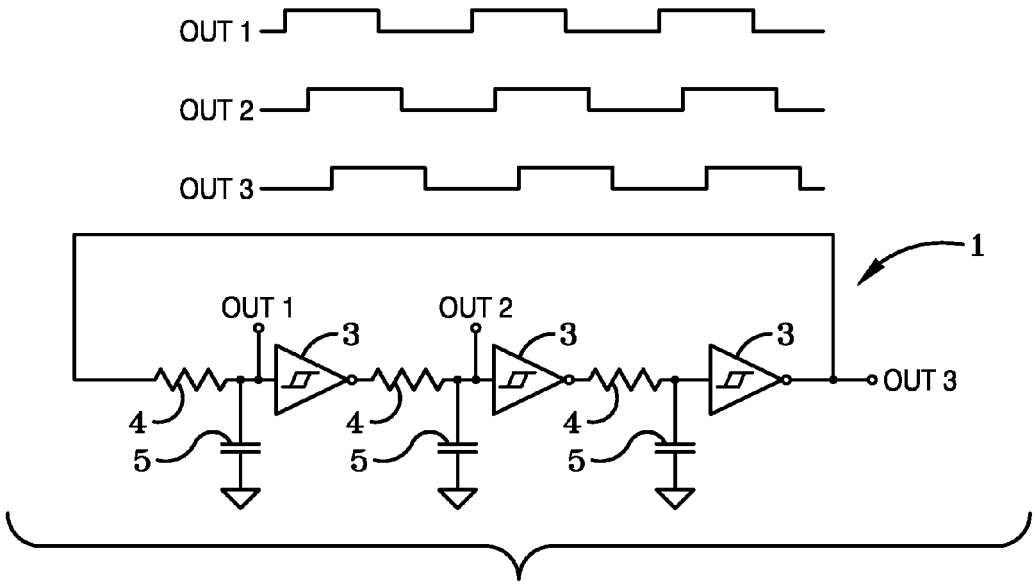
FIG–1 PRIOR ART
FIG. 1 illustrates a prior art circuit for generating pulses.

Before describing the preferred embodiment, FIG. 1 that illustrates the a prior art clock generator 1 will be briefly introduced so that the preferred embodiment is more easily understood. The clock generator of FIG. 1 has Schmitt trigger types of inverters 3 three resisters 4 and three capacitors 5. If all the resistors 4 are of equal value and the capacitors 5 all have equal values then each of their charging time constants are the same. This means that each capacitor with charge and discharge at the same exponential rate which is based on the product of the resistance times the capacitance. Of course, the Schmitt trigger inverters 3 will not change polarity unit either their rising voltage reaches an upper trigger level or a falling voltage reaches a lower trigger level. With resistors and capacitor pairs being the same, output of each inverter 3 are delayed by a third of the pervious inverter as is also illustrated in FIG. 1.

Figure 2:
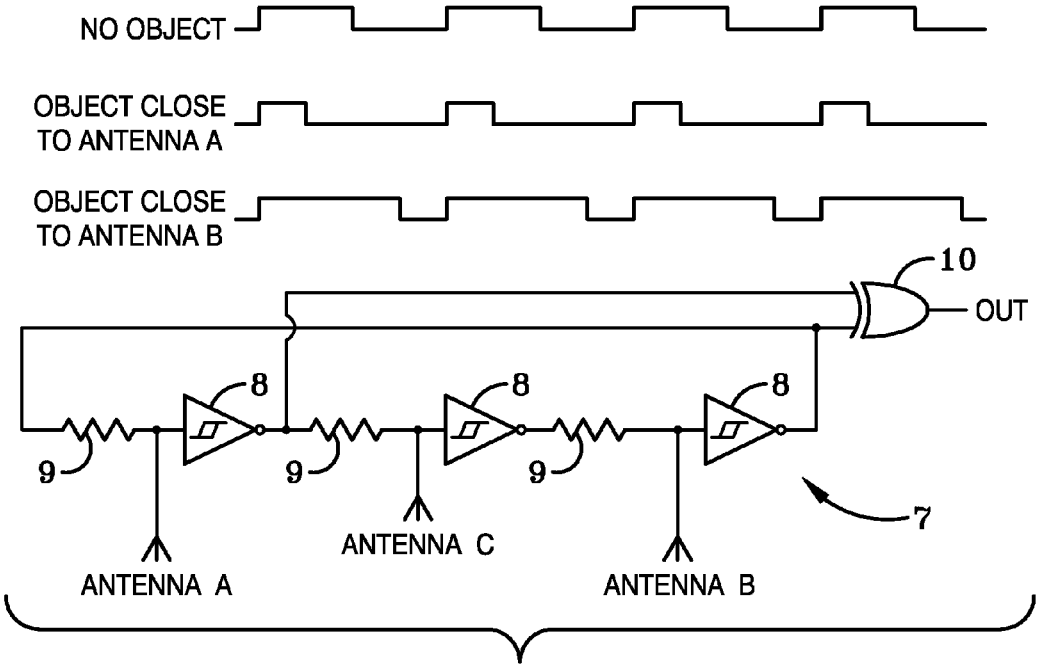
FIG. 2 illustrates a preferred embodiment of generating clock pulses using the capacitance of antennas.

FIG. 2 illustrates one primary component of the preferred embodiment of the invention that is a clock generation and detection logic 7. "Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like an application specific integrated circuit (ASIC), a programmed logic device, a memory device containing instructions, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

The clock generation and detection logic 7 includes inverters 8 and resistors 9 arranged back-to-back to create a clock similar to the clock generator of FIG. 1 discussed above. However, the capacitors of FIG. 1 have been replaced by antennas A-C. If the capacitance of each antenna A-C is similar to the capacitors of FIG. 1 then a 50 percent duty cycle clock should be created similar to FIG. 1. Note that the inverters 8 supply transmit power to the antennas A-C and that the antennas A-C are able to receive electromagnetic signals that may be altered when an object moves within range of one of the antennas A-C. In summary, the antennas A-C each simultaneously transmit and receive electromagnetic signals.

Figure 3:
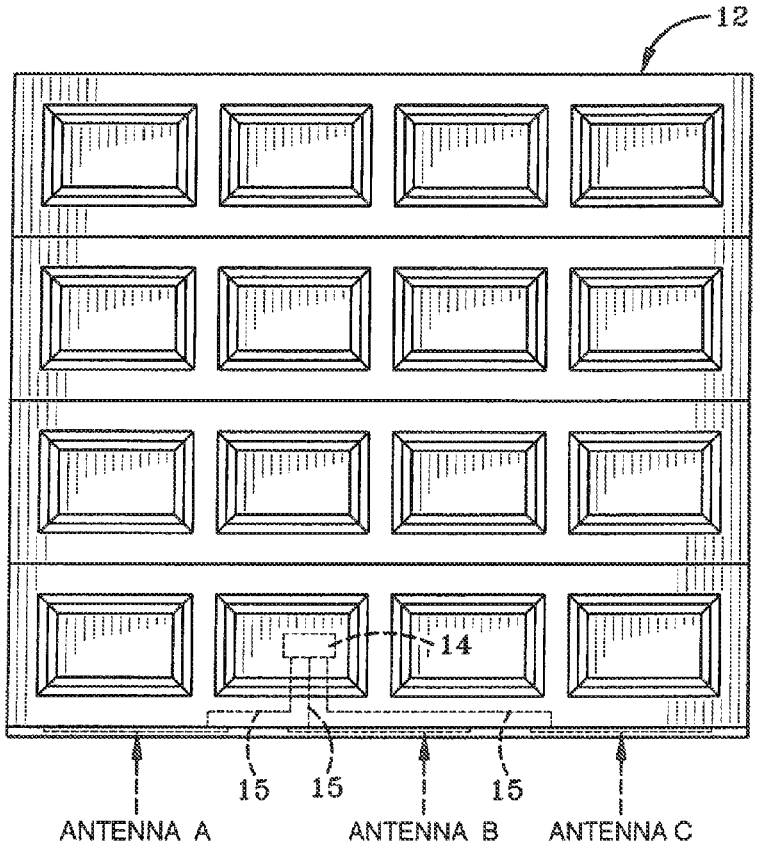
FIG. 3 illustrates an example placement of antennas and an alarm logic on a garage door.

The clock generation and detection logic 7 further includes a "exclusive-or" (XOR) gate 10. When no object is near the antennas A-C the clock is passed through the XOR gate 10 with its 50 percent duty cycle. However, when an object is near antenna A or B the duty cycle of the output of the XOR gate 10 is changed as illustrated. In the preferred embodiment these antennas A-C are placed along a lower edge of a garage door (as illustrated in FIG. 3 and discussed below) and the distortion detected by the clock generation and detection logic 7 when something approaches an antenna is very small and are often much less than one percent of the duty cycle. As discuss below, even though there is only a small change of duty cycle, amplification logic can be used to amplify it. Even though a change in pulse width was discussed, those of ordinary skill in the art would realized the clock generation and detection logic 7 could be design to detect changes in frequency, phase, amplitude and the like all based, at least in part, on the capacitive value of an antenna being altered when objects move within its environment.

While this description focuses on generating a clock using capacitance values of an antenna (RC circuits) it is understood that resistance-inductive-capacitance (RLC) circuits, inductive-resistive (LR) circuits, inductive-capacitance (LC) circuits and the like could all be used to generate a clock similar to what is shown in FIG. 2.

The clock generation and detection logic 7 has been introduced with respect to a door, however, it has a wide variety of possible uses. For example, it can be used to detect people on opposite sides of walls and, thus, can be used for security purposes. For example, it can generate an alarm if it detects movement within a bank during non-banking hours. It can be used to detect if a safe or a mailbox is being opened on a side of a wall opposite to the clock generation and detection logic 7. In another application, the detection logic can detect if finger or another object is in the opening of a car window and prevent the closing of the car window when the finger or object is detected in the car window opening. Those of ordinary skill in the art will appreciate the many possible uses of this embodiment of the clock generation and detection logic 7. As illustrated below in FIG. 4, it can be combined with electrical logic to build useful alarming and warning systems.

FIG. 3 illustrates one possible way the antennas A-C of FIG. 2 can be mounted on a bottom edge of a garage door 12. The example garage door 12 has for hinged panels and can travel up and down guided within a track by wheels periodically spaced at ends of the door 12. In this example illustration, the antennas A-C are connected to an alarm logic 14 with wires 15. The alarm logic 14 can be mounted on or in a lower door panel as illustrated or it can be mounted in other locations. Alternatively the alarm logic 14 or portions of it can be mounted remotely from the door 12 itself. As discuss later, the alarm logic 12 can sends signals to a motor opening or closing the door 12 to tell it to stop when movement is detected near the door.

Figure 4:
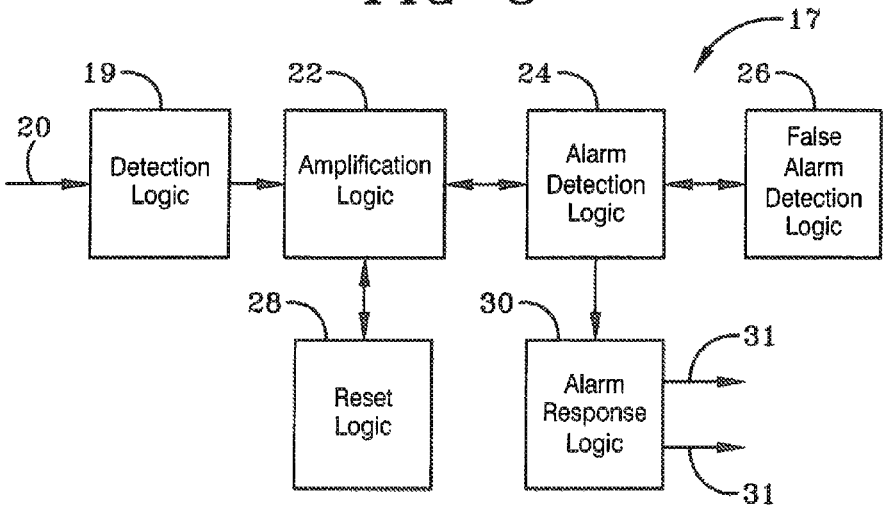
FIG. 4 illustrates the example logic of the preferred embodiment of an alarm/motion detection system.

FIG. 4 illustrates some components of an alarm system 17 that can in include one or more of: a detection logic 19 that receives one or more inputs 20, an amplification logic 22, an alarm detection logic 24, a false alarm detection logic 26, a reset logic 28 and an alarm response logic 30 that can have one or more outputs 31. In the preferred embodiment, the detection logic 19 is similar to the detection logic discussed above in that it is generally constructed with a clock generation circuit with its capacitance based on antenna capacitance. The input 20 can be an electromagnetic field. The detection logic 19 can be designed to detect a phase shift, a change in frequency, a change in voltage amplitude and/or other changes resulting from a change in the electromagnetic field input.

As mentioned above, the changes that the detection logic 19 can detect are often quite small so the alarm system 17 amplifies them with the amplification logic 22. In general the amplification can be implemented with one or more amplifiers as understood by a person of ordinary skill in this art. For example, operational amplifier(s) (Op Amps) could be used, discrete transistors, and/or other components could be used. In one embodiment discussed later it may be possible to use a single PLL in a new novel amplifier configuration to perform the amplification.

After the signal is amplified, it is input to the alarm detection logic 24 which monitors the signal and looks for possible alarms. In each of the many environments where the alarm system 17 might be used there are unique conditions to that environment. These unique conditions may generate false alarms when the alarm detection logic is primarily looking for a signal to cross a threshold. For example, if the antennas of the detection logic 19 are on the bottom of a garage door and the garage door is activated to begin moving from a position of rest on a hard floor the antennas would generate a very significant signal that something (the floor) is moving away from them and thus the alarm detection logic 24 may falsely generate an alarm.

The false alarm detection logic 26 can check for special false alarm conditions. For example, the false alarm detection logic 26 might detect early in the amplification process that a signal is so large that it must be a false positive and that in reality that there is no alarm condition for present set of conditions. The false alarm detection logic 26 lets the alarm detection logic 24 know that this is a false alarm so that it won't actually generate an alarm.

The alarm response logic 30 generates an actual alarm when instructed to by the alarm detection logic 24. For example, in response an alarm, the alarm response logic 30 can generate a signal to halt the movement of a door and send that signal to a controller or a motor that is operating the door instructing it to stop moving the door. Alternatively, it might send out a signal to remove power to a motor that is causing the movement of the door.

The reset logic 28 is used to generate reset signals that may be needed during the operation of the alarm system 17. For example, it generates a power on reset that places all the logic components the system 19 in an initial state before they begin to operate. Additionally, some components of the amplification logic 22 may need reset after the alarm detection logic 24 has detected an alarm. For example, switches as discussed below may need to be open or closed to clear Op Amps after some alarm conditions. The reset logic 28 may also generate signals in response to false alarm conditions as discussed below.

Figures 5, 5A:
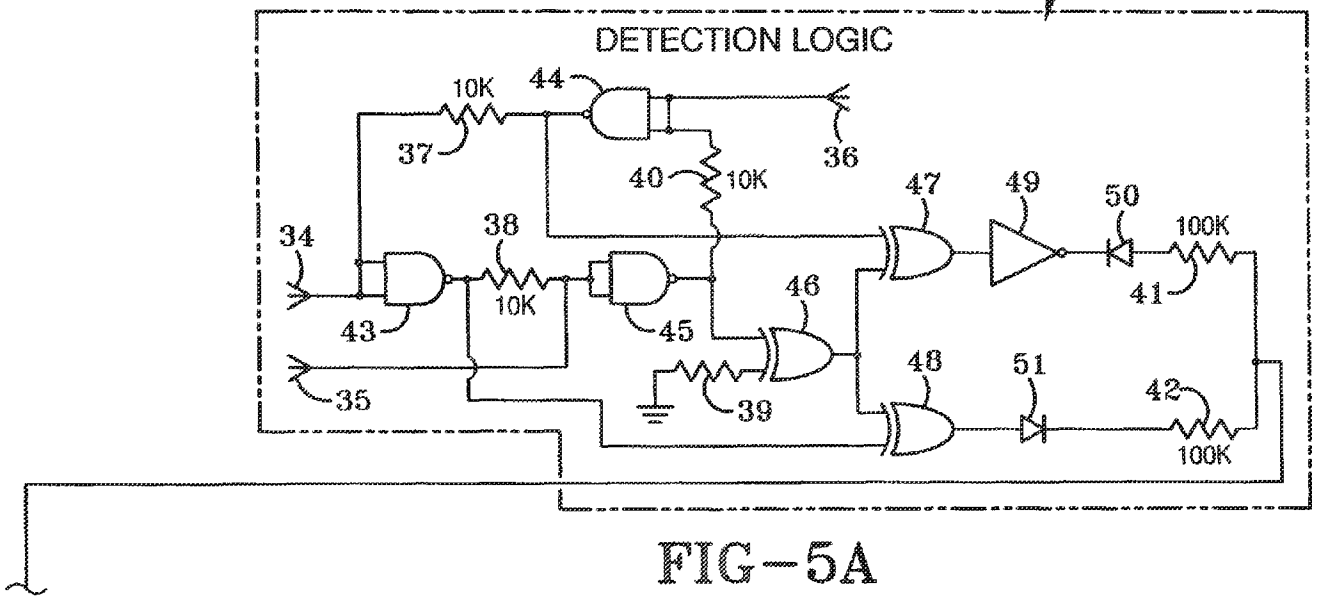
FIG. 5 including
FIGS. 5A-F is an example schematic of a preferred embodiment of an alarm/motion detection system for a garage door.

FIG. 5 illustrates an example schematic system that has been implemented as a working prototype of an alarm system 33. The alarm system 33 can also be referred to as motion detection logic 33 because it generate alarms based on the detection of motion. The alarm system 33 will be described with reference to generating controls/alarms when motion, movement and/or other events occur near a garage door, however, portions of the alarm system 33 can be used to detect motion in many other environments and applications. The different sections of the schematic have boxes drawn roughly around them and have been labeled with labels such as "DETECTION LOGIC", "AMPLIFICATION LOGIC" and the like. Those of ordinary skill in the art may have drawn these boxes and labeled them differently. The boxes and the corresponding labeling are merely intended to aid one or ordinary skill in the art in understanding what some of the major components of this system 33 are and do not limit the scope of the preferred embodiment in any way. Additionally, these boxes and the corresponding labeling can be implemented completely differently than what is shown in FIG. 4 even though some of the labeling may be the same between FIG. 4 and FIG. 5.

Detection of an object moving near a garage door is performed by the "detection logic" 19 generally located in the upper left side of FIG. 5. The detection logic includes antennas 34, 35, 36 each connect to an input of a NAND gate 43, 44, 45. These three NAND gates and their corresponding resisters 37, 38, 40 form a clock generation circuit similar to FIG. 2 discussed above. XOR gates 46, 47, 48, diodes 50, 51 inverter 49 and resistors 41, 42 work together to generate pulses similar to the XOR gate discussed above of FIG. 2. Those of ordinary skill in the art will appreciated that XOR gate 46 has one input connected to ground so that it acts as an inverter and is not needed but can be useful when experimenting with different antennas. This figure is illustrated with three antennas 34, 35, 36 so that two outside antennas could be placed on each end of a door and a center antenna can be placed near the center of the door. The center antenna could still detect something approaching a center portion of the door that the two outside antennas may not detect. Of course, in other embodiments, one, two or more than three antennas could be used.

The area labeled "amplification logic" 22 (FIG. 5C) amplifies and filters the pulses of the detection logic so that the "alarm detection logic" 24 (FIG. 5D) area of the system 33 can determine when to generate an alarm. The "amplification logic" includes Op Amps 52-55, resistors 57-66, inverter 56, capacitors 67-72 and 77, as well as switches 73-76. In general, this logic includes Op Amps 52, 53 acting as voltage amplifiers followed by Op Amps 54, 55 acting as low pass filters to get rid of 60 Hz noise as well as other noise. The resistance on resistors 57, 58, 61, 63 biasing Op Amps 52, 53 are very high to provide a charge time constant that is slow. Op Amp 52 has large input resistance so that it operates as an integrator. This allows an object moving near the one of the antennas 34, 35, 36 to be integrated while it is moving near one of the antennas. The switches 73-76 can be transistors used as switches. As discussed further below, these switches are used to reset the Op Amp (integrators) after an alarm has been detected.

Note that the integrating Op Amps operate so that they sample, hold and compare. They act as analog memories that remember prior values and hold those values. As new values are received, they compare the new values to older held values and update the held value when even very small offsets are detected. However, periodically the held values are reset (by the pulse generation logic discussed below with reference to FIG. 5E) so as to not integrate too much background noise and generate a false alarm.

The area labeled "alarm detection logic" (FIG. 5D) determines when to generate an alarm. The logic includes resistors 84-88, inverters 78-82, NAND gate 83 and capacitor 77A. Resistors 84-87 are in a voltage divider configuration to bias inverter 78 slightly positive so that it is almost ready to switch. Similarly, lower inverter 80 is biased lower so that if its input voltage goes much lower it will turn on. The outputs of the inverters are combined in NAND gate 83 to generate a signal that indicates an object moved "to close to" or "too far away from" an antenna and so that this signal indicates an alarm may need to be generated. The immediate output of the NAND gate is a temporary "alarm disable" that travels through resistor 128 in the "alarm response logic" 30 (FIG. 5F) and through diode 111 in the "reset and false alarm detection logic" 28 (FIG. 5E). This signal is used to temporarily disable an alarm in case that alarm was generated by, for example, the door being lifted off a garage floor and is further discussed below.

The output signal of NAND gate 83 that passes through the RC delay circuit formed by resistor 88 and capacitor 77A is a delayed alarm signal that is also used to determine if a possible alarm is indeed a real alarm. Additionally, this signal is used, at least in part, to generate signals that will close switches 73, 74, 75 of FIG. 5C that reset the integrators 52, 53 and the low pass filter 55 so that these integrators 52, 53 can again be integrating the output signal of the "detection logic". This allows the "alarm detection logic" to once again detect another alarm which in turn again results in the integrators being reset. The end result of all of this is that the faster and/or closer an object approaches an antenna the faster alarms are generated. Similarly, the slower and/or further away an objects moves from an antenna the slower alarms are generated.

Figure 5B:
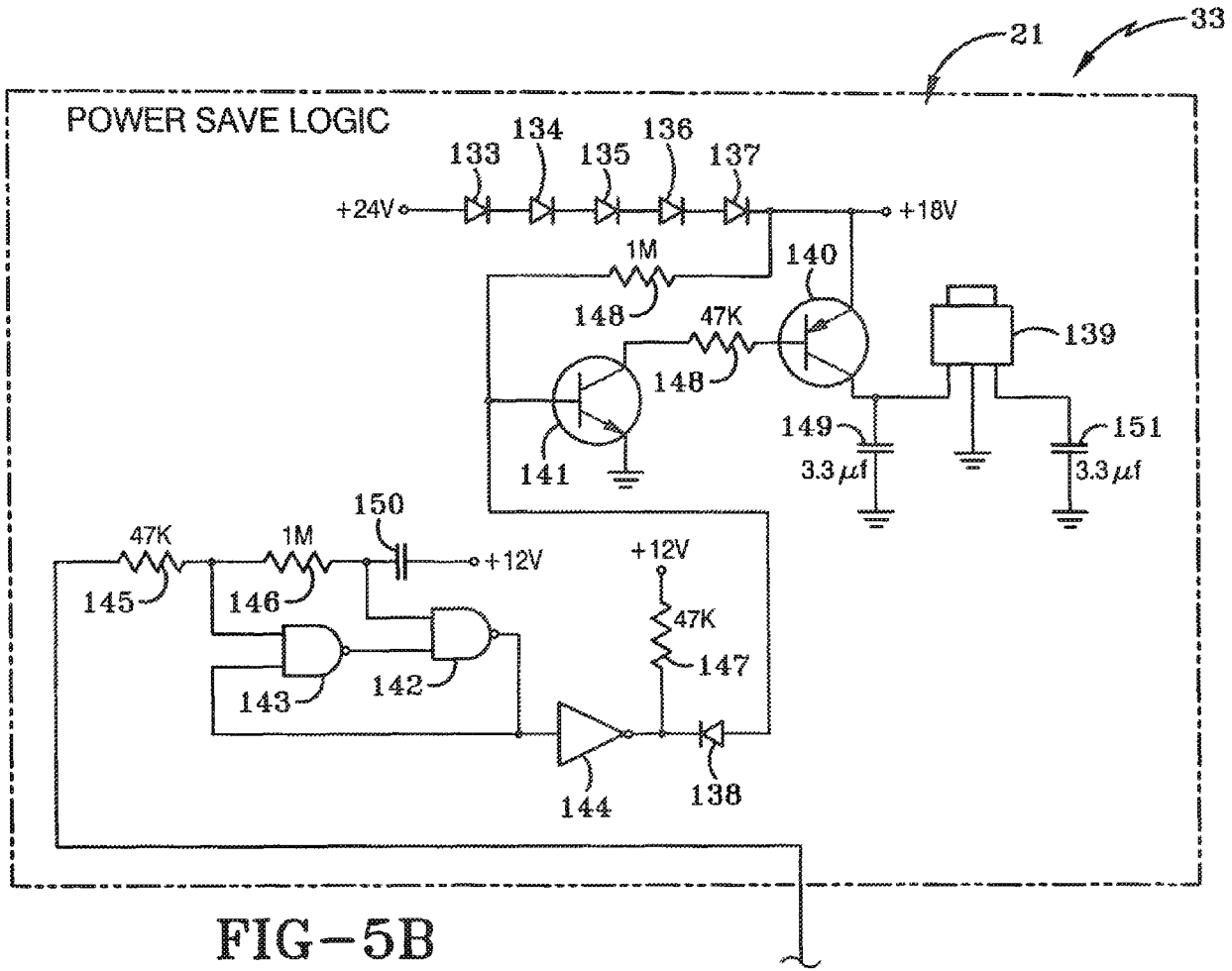
Figure 5C:
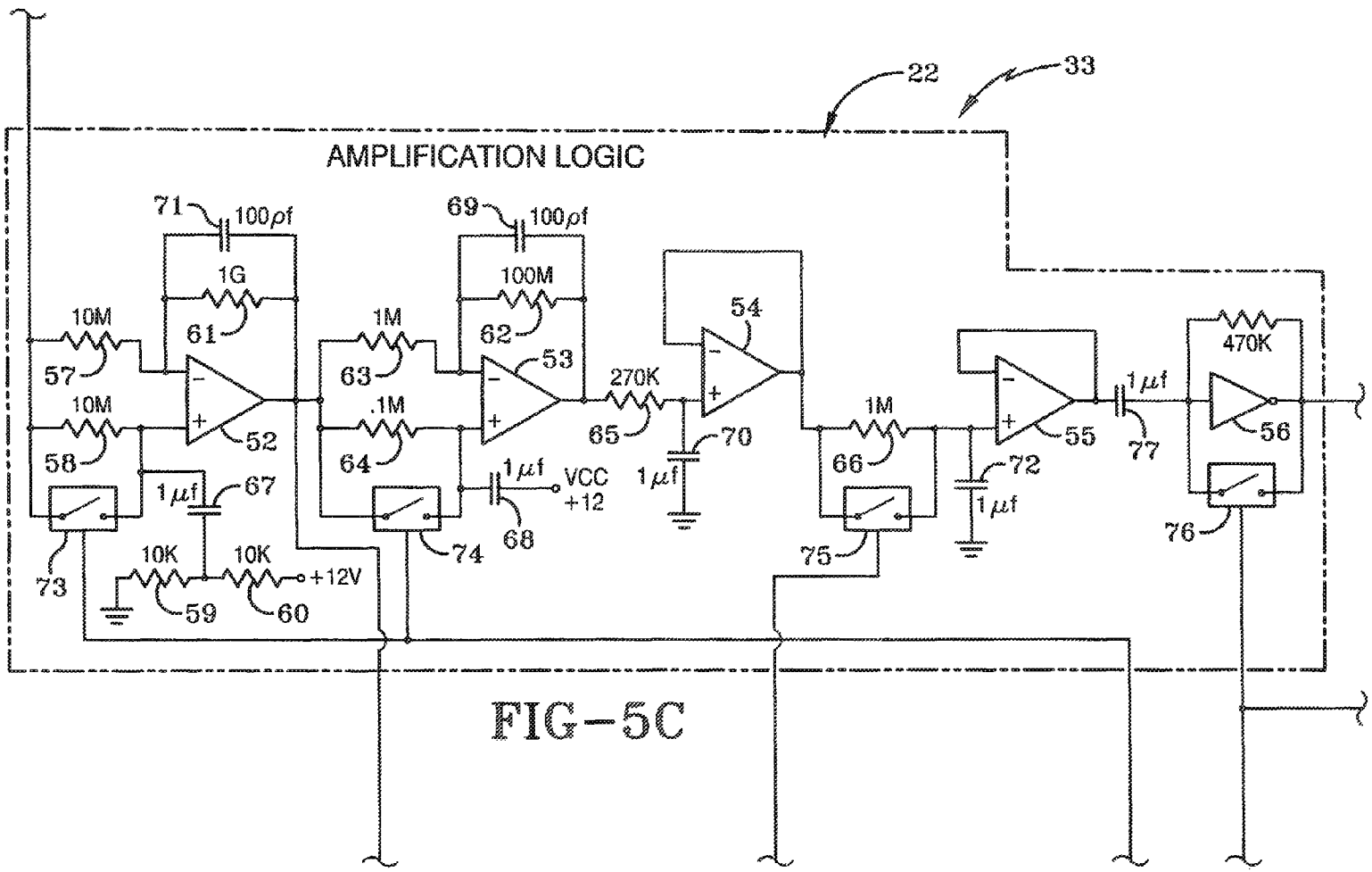
Figure 5D:
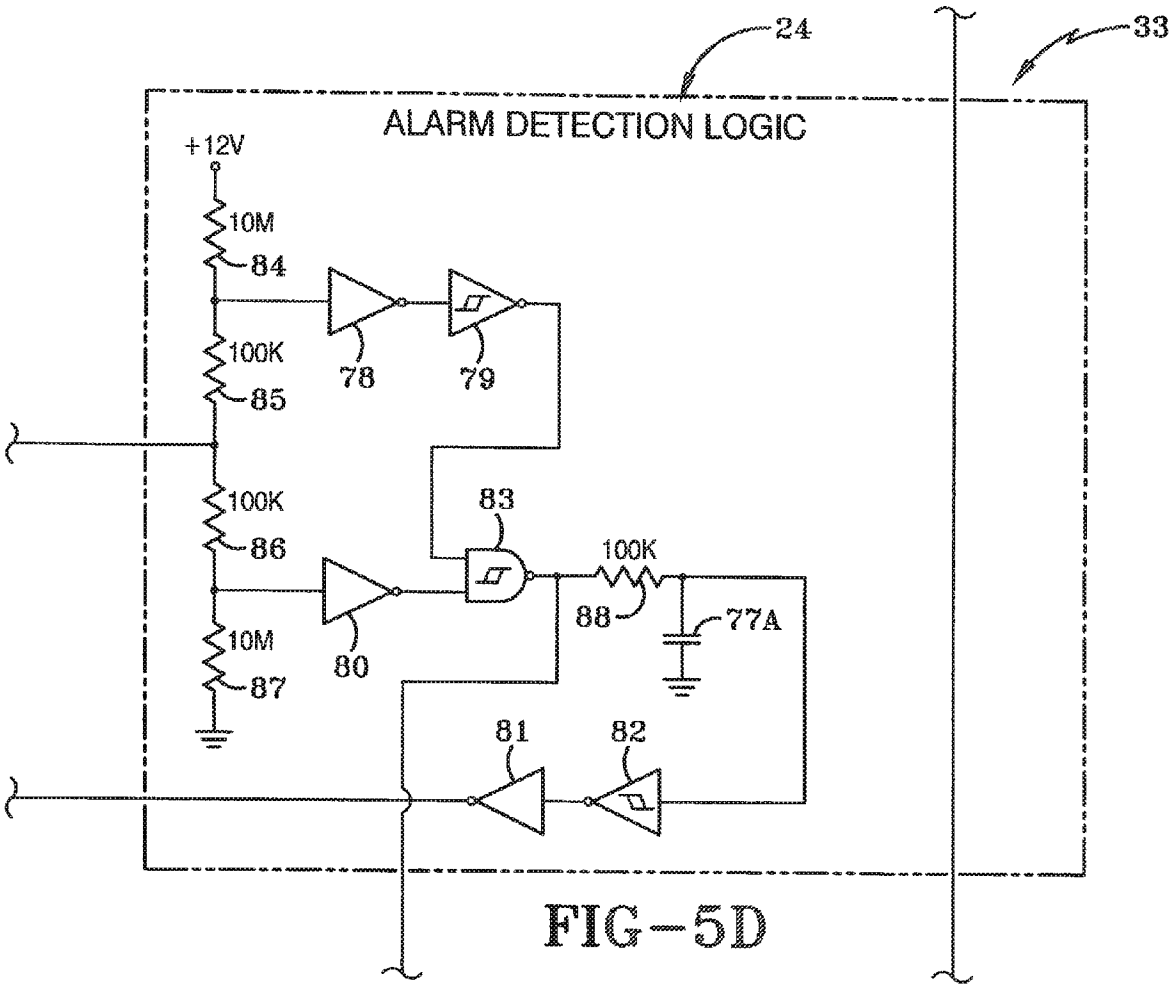
Figure 5E:
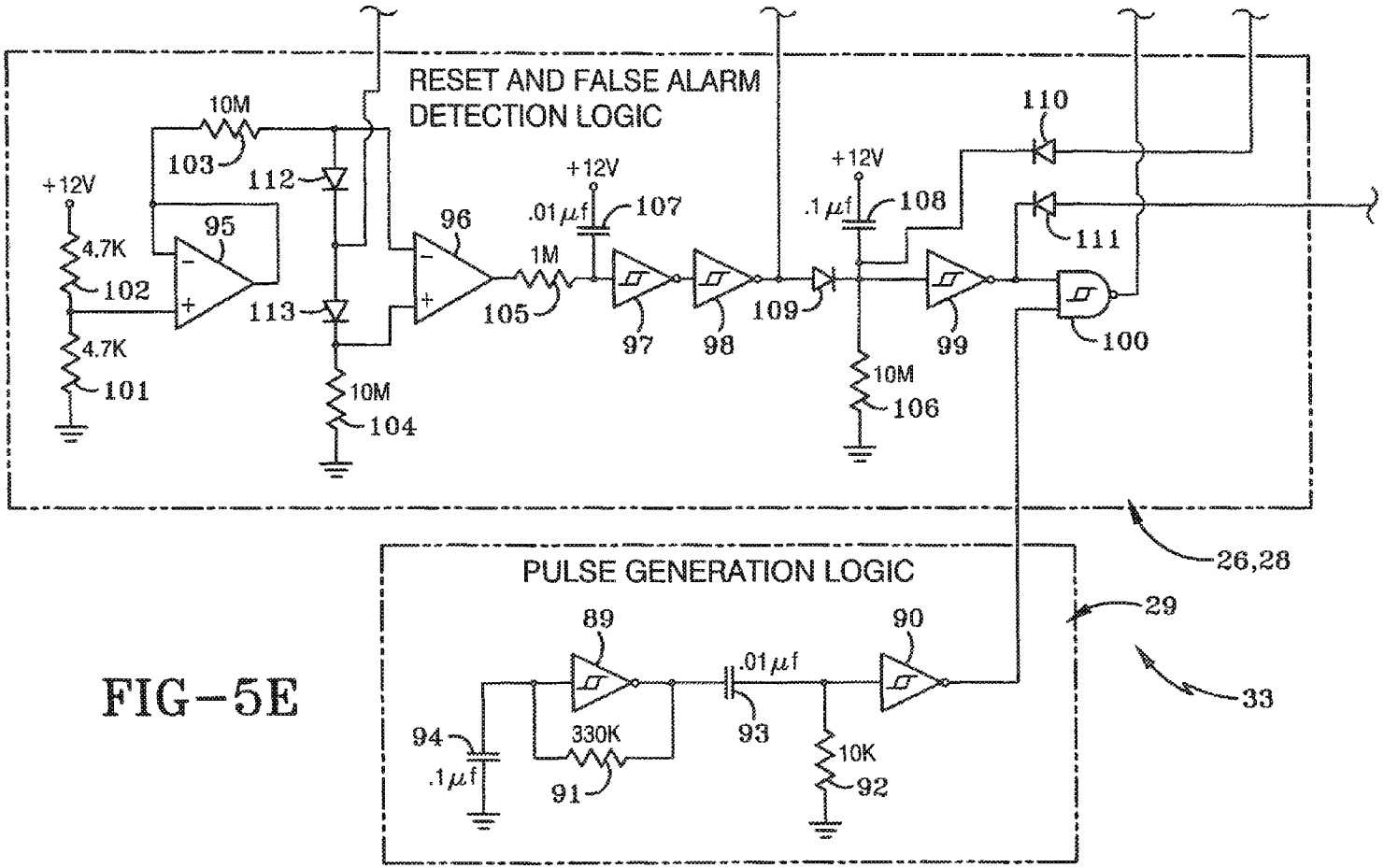
Figure 5F:
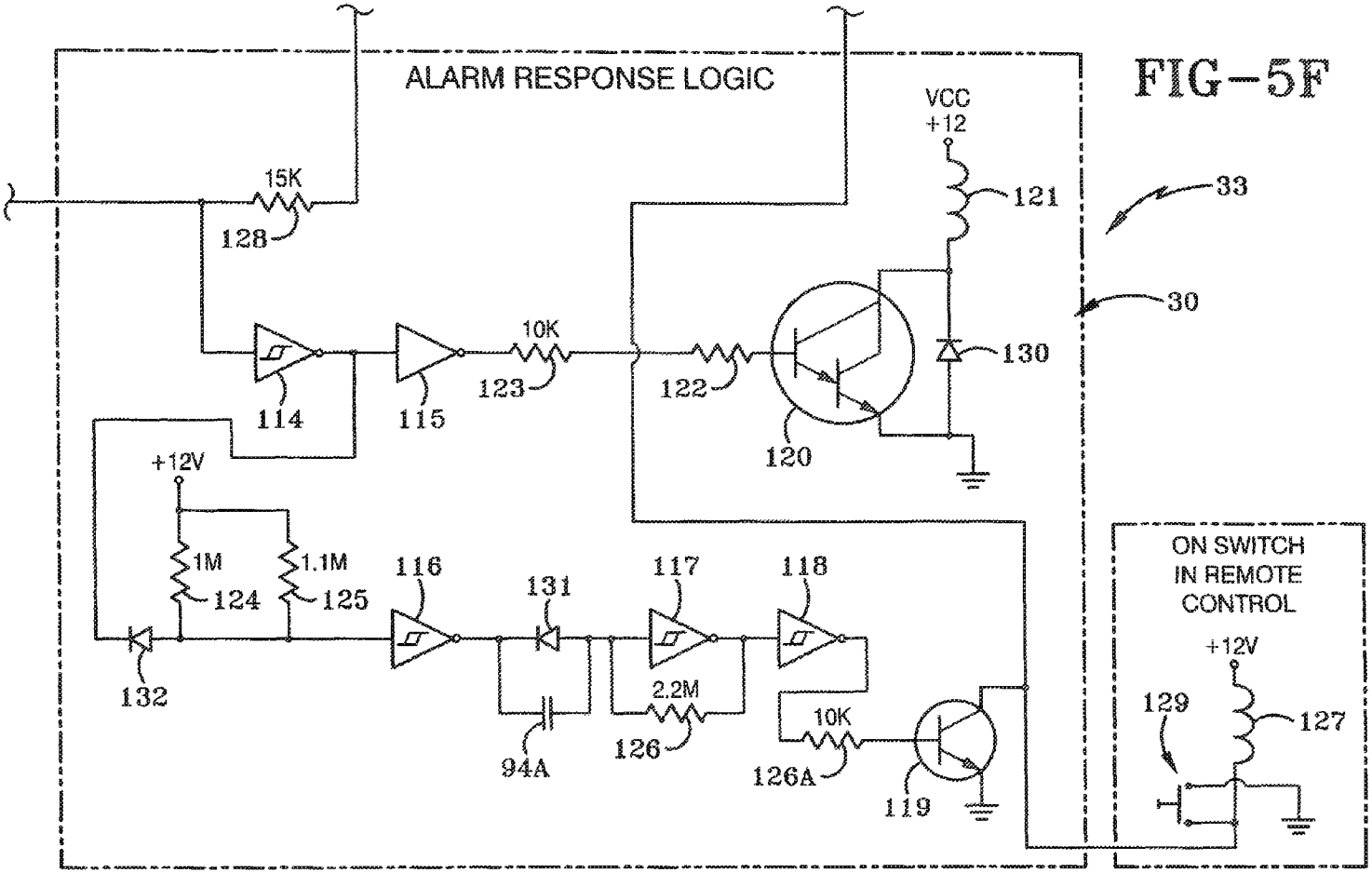

FIG. 5F illustrates example "alarm response logic" and an "on switch in a remote control". The "on switch in a remote control" is an optional device that is a radio transmitter that was useful when experimenting with different embodiments of the system 33. The remote control includes an inductor 127 and a switch 129. The "alarm response logic" includes inverters 114-118, inductor 121, transistors 119, 120, resistors 122-126 and 126A as well as diodes 130-132. The inductor 121, transistor 120 and resistor 122 create a physical connection to a relay of the external garage door system that is external to the alarm system 33, any other appliance or system. These components can be used to interrupt (turn off) the power supply wherein it is supplied to the external garage door system. Inverters 116, 117, 118, resistor 126A and resistor 126 are used to create a delayed "count" that restores power to the external garage door system a certain time period after that power has been interrupted.

FIG. 5E illustrates one example of "reset and false alarm detection logic" and one example of "pulse generation logic". The "pulse generation logic" 29 includes capacitors 93, 94 inverters 89, 90 and resistors 91, 92. This circuit generates a stream of pulses with small duty cycles to periodically reset the AP Amps of the "amplification logic" so that they do not constantly integrate a false signal that results in generating a false alarm. For example, their duty cycle can be one percent of a total cycle.

The "reset and false alarm detection logic" includes Op Amps 95, 96, resistors 101-106, capacitors 107, 108, diodes 110-112, inverters 97, 98, 99, and NAND gate 100. Op Amp 95 is in follower configuration to supply power to diodes 112, 113, and Op Amp 96. Both diodes 112, 113 are both partially "on" with the output of the first Op Amp 52 of the "amplification logic" connected between them. This allows the first amplifier stage (Op Amp 52) to indicate that an exceedingly large input was received from an antenna that may be a false alarm. For example and as previously mentioned, when a garage door is properly instructed to open after resting on the ground, the antennas will quickly detect that the floor is moving away from the antennas and generate a false alarm that generates a strong signal at the output of the first amplifier stage (Op Amp 52). A positive signal from the first amplifier stage will turn the bottom diode 113 on and a negative signal will turn the top diode 112 on. The output of Op Amp 96 is used to eventually generate a signal that indicates the possible alarm is a false alarm and should be disregarded. Capacitor 108 requires the signal from first amplifier stage (Op Amp 52) to be seen at least a short time before actually generating a signal that determines the first amplifier stage has detected a false alarm. When a false alarm is detected, Capacitor 108 and resistor 106 will allow alarms to now be ignored until the capacitor 108 changes enough to turn inverter 99 "on". This circuitry prevents the door from stopping an inch or so above the floor and never fully opening.

The example "power save logic" 21 of FIG. 5B includes diodes 133-138, resistors 145-148, transistors 140, 141 and 147 NAND gates 142, 143, inverter 144, voltage regulator 139 and capacitors 149, 150, 151. One of ordinary skill in the art will realize that the "power save logic" allows the alarm system 33 to go to sleep and then later wake up in order to save battery power.

The alarm system 33 can be built with various preconfigured functions. For example, the alarm system 33 can include logic that just stops a garage door on its way down to prevent something/someone from being crushed. However that something or someone may be stuck under that stopped door. Alternatively, when an alarm is detected when the door is moving downward, logic in the alarm system 33 can be configured to stop the door and then cause the door to return to an upward position. However, this carries the risk that something may be dragged upward by the door and the possible that someone can be hung. Additionally, when a garage door is being moved in an upward position and motion is detected by the alarm system 33, its logic can cause the door to stop moving upward and remain in a partially open position. The alarm system 33 can be built to implement one or more of these reactions to the detection of motion and a manufacture of doors or a buyer of the alarm system 33 can balance the risk and operation of their door and select one or more of the pre-configured responses best suited to their use.

In summary, the example motion detection circuit 33 of FIGS. 5A-5F has four different resets. First, upon power on, a reset is generated to synchronize appropriate circuits. Secondly, larges false alarm signals generated when the door first starts going up (or down) are detected by Op Amp 52 (FIG. 5C) and the circuit 33 sends resets to appropriate logic to prevent false alarms. Third, the pulse generation logic (FIG. 5E) in general generates a free running clock with a duty cycle of one percent or less that periodically resets the Op Amps as illustrated so that the Op Amps do not eventually integrate enough background noise to generate a false alarm. Fourth, when an alarm is generated it will also generate a reset so that the motion detection circuit 33 can begin to look for another alarm.

Because resets are generated after each alarm is detected, it is possible to detect a speed of an object approaching the garage door and a direction of that object. For example, when alarms are generated faster and faster it may be determined that an object is approaching the door and the time between alarms may correspond to a speed of that object. Short times between alarms mean the object is approaching slower than when there is a slower time between alarms. If the time between alarms is getting longer, it may mean that an object is moving away from the door. Therefore, there may be some situations in which at least portion of the alarm system 33 may be used to detect the speed and/or directions of moving objects somewhat like radar systems.

Figure 6A:
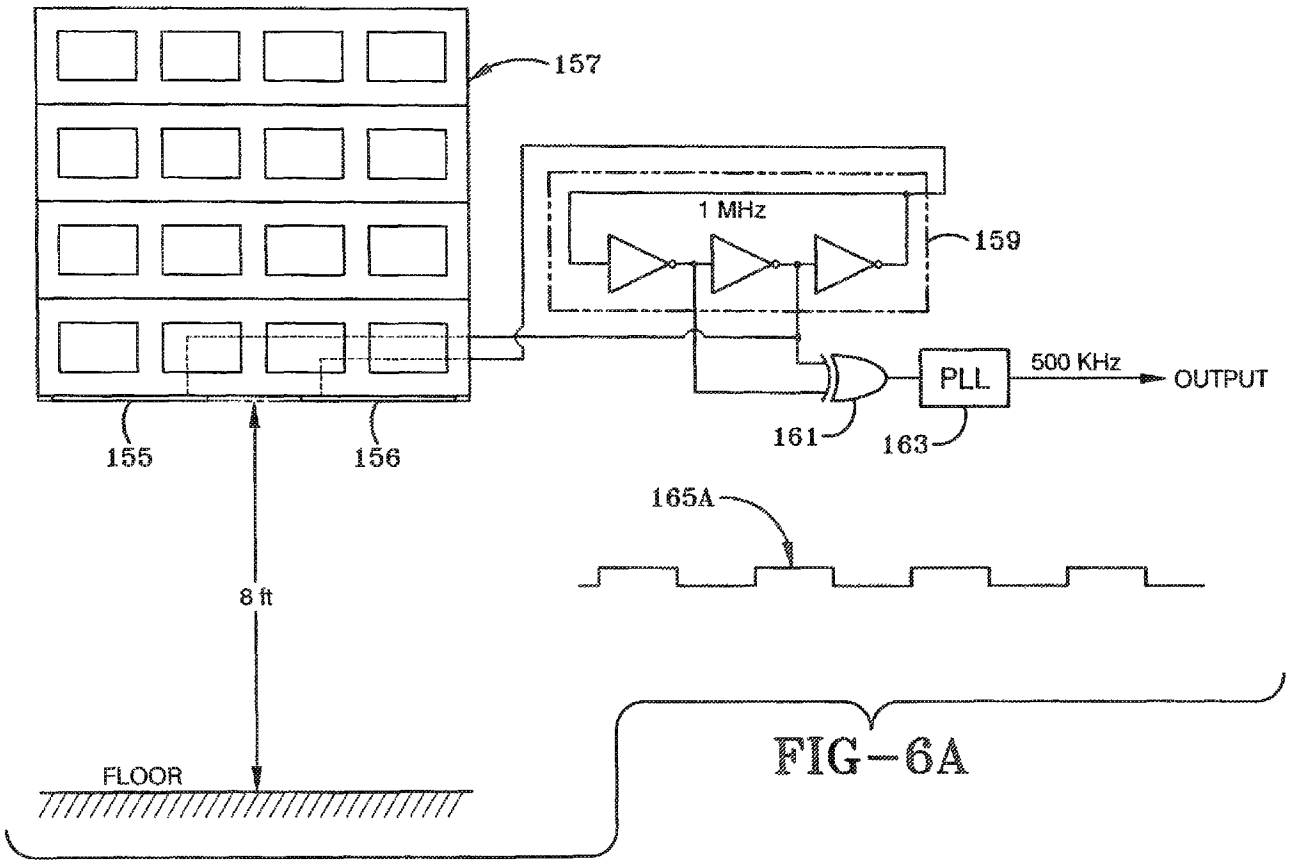
FIGS. 6A-6B illustrate an example alarm/motion detection system for a garage door that uses a phased locked loop (PLL) for amplification.
Figure 6B:
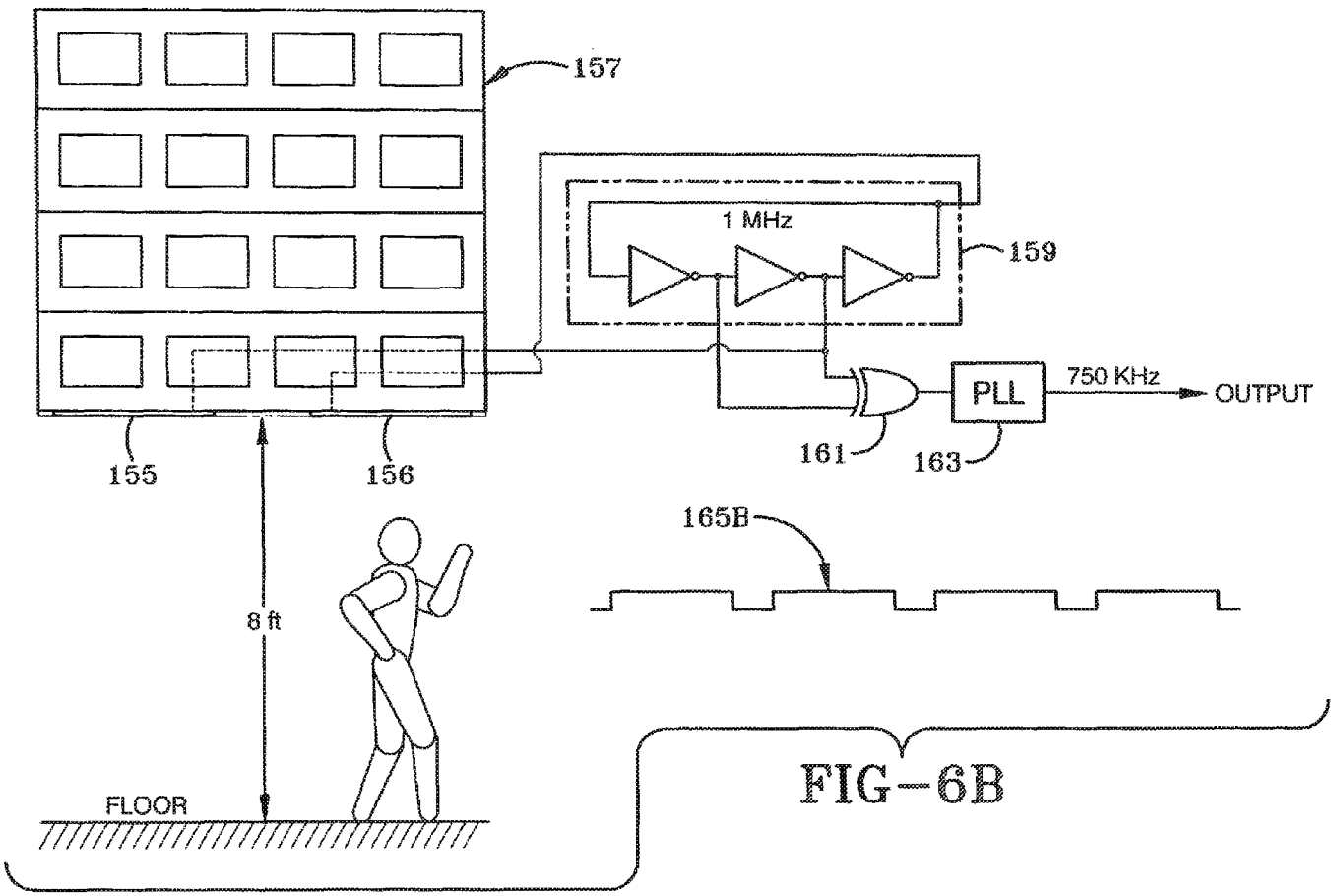

FIGS. 6A and 6B illustrate a motion detection circuit that uses a PLL to amplify a small signal that detects motion. The circuit has a two antennas 155, 156 connected to a lower end of a garage door 157 similar what was discussed above. The circuit also has a pulse generation logic 159 similar to pulse generation logics discussed above that use the capacitance of the antenna(s) as the capacitance in oscillating RC circuits. For simplicity, no resistors are shown in the pulse generation logic 159 but this logic could contain resistors.

Also similar to the above, an XOR gate 161 is used to create pulses. The pulses are then input to a phase-locked-loop (PLL) circuit 163. As discussed above, when nothing is approaching any antenna 155, 156, the duty cycle of the pulse created by the XOR gate 161 is 50 percent as illustrated by the output signal 165A. Notice in FIG. 6A that when the garage door 157 starts its decent the frequency at the pulse generation logic 159 is 1 MHz but the frequency of the output of the PLL 163 is 500 KHz but the duty cycle is still 50 percent. This will be true as long nothing approaches any antenna 155, 156. It should be noted the PLL 163 is biased in an "off center" mode and that the term "off center" is further defined below with reference to FIGS. 9A-C FIG. 6B is similar to FIG. 6A, however, now a person 166 is approaching antenna 156. This created a difference in capacitance between the two antennas 155, 156 so that the duty cycle of the pulses output from the pulse generator 159 and the XOR gate 161 have longer duty cycles. Of course, if is something moves toward the other antenna 155, the duty cycle may go below 50 percent. The PLL 163 amplifies the increase of duty cycle to create an output 165B. After amplification, the difference in duty cycle can be detected as discussed above and/or by another method as understood by those with ordinary skill in the art.

Figure 7:
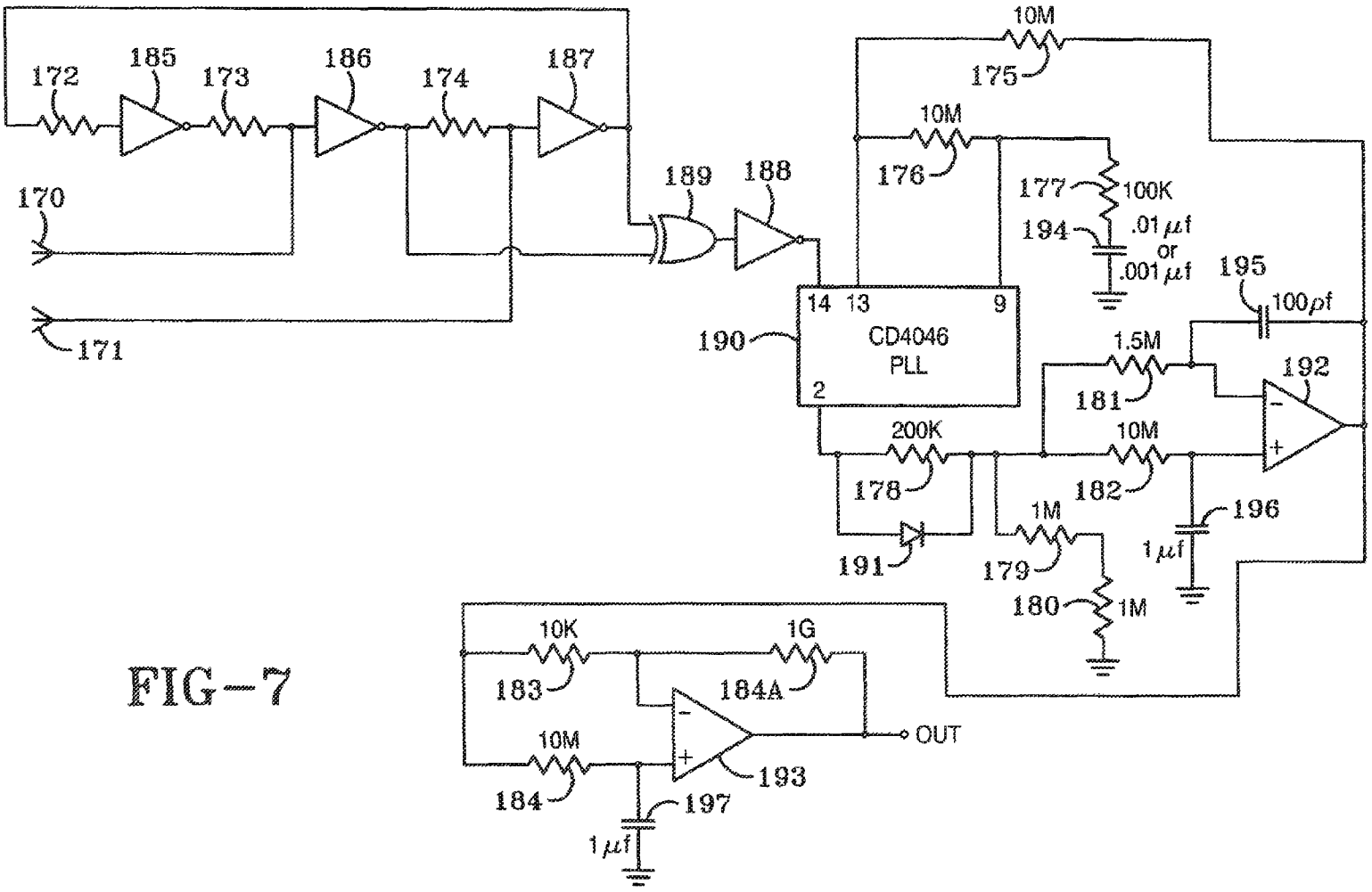
FIG. 7 illustrates another example alarm/motion detection system for a garage door that uses a PLL for amplification.

FIG. 7 illustrates another circuit that detects motion based on the capacitance of antennas. This embodiment includes a pulse generation logic similar to what was discussed above that is created by antennas 170, 171 resistors 182-185, inverters 185, 186, 187, and NOR gate 189. The output of the pulse generation logic is input to a PPL 190 similar to the PLL 163 of FIG. 6 where it is amplified. In particular, this PLL 190 can be a 16 pin Texas Instruments "CD4046" PLL. The output of the pulse generation logic is input in pin 14 of the CD4046 and the "amplified signal" is output from pin 2. Feedback is provided to pin 9 as illustrated. Feedback and other circuits are formed with resistors 175-184 and 184A, Op Amps 192, 193, diode 191 and capacitors 194-197. These circuits can generate and provide feedback signals to pins 13 and 9 that so that the PLL 190 operates in the correct mode. In essence, the feedback circuits are designed to get rid of frequency deviations and to provide changes in phase back to pin 9 of the PLL 190. This is useful in controlling a garage door, for example, to allow the door to get closer to the floor before needing to account for a false alarm because the floor causes such a strong signal the closer the antennas 170, 171 get to the floor.

Additionally, because both the rapid changes in phase from pin 2 and delayed changes from pin 13 are both feed back to the voltage controlled oscillator (VCO) input pin 9, the PLL 190 is partly biased to an "off center" mode. The "off center" mode is more fully defined below with reference to FIG. 9A-C. If resisters 175, and 176 were much larger to isolate the two different feedback paths then the PLL 190 would be more fully in an "off center" mode.

Figure 8:
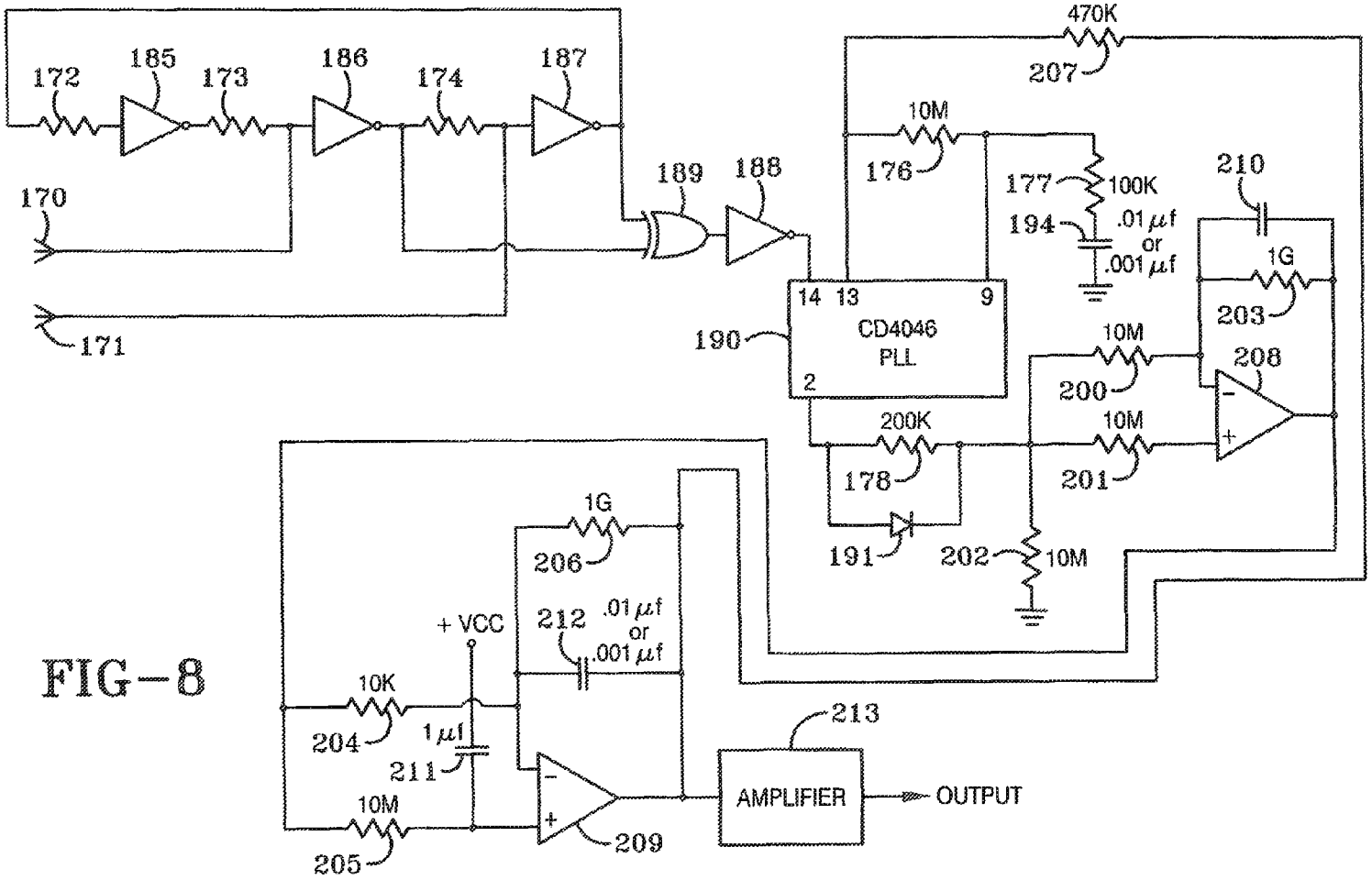
FIG. 8 illustrates another example alarm/motion detection system for a garage door that uses a PLL for amplification.

FIG. 8 illustrates another embodiment of a circuit for detecting motion using a CD4046 PLL similar to FIG. 7. The front portion through at least the CD4046 PLL 190 is similar to FIG. 7. Backend components beginning at reference number 200 are different. The backend components include resistors 200-207, capacitors 210-213, and Op Amps 208, 209. Similar to FIG. 7, these components can be used to generate and provide feedback phases to pin 9 so that the PLL 190 is biased/controlled to partially operate in an "off center" mode that is discuss further below with reference to FIGS. 9A-C.

Figure 9A:
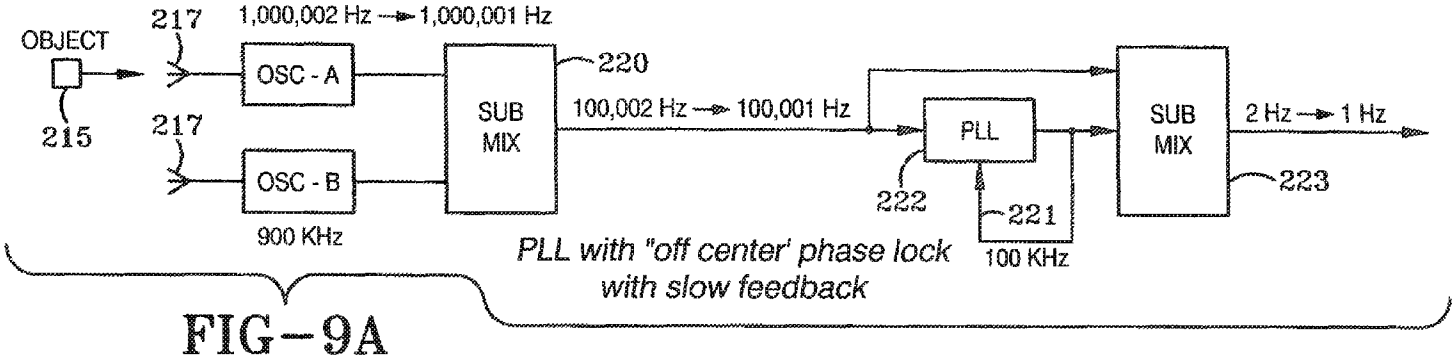
FIGS. 9A-9C illustrates an example alarm/motion detection systems for a garage door that use a PLL that is biased in an "off center" mode for amplification.

FIG. 9A illustrates a different embodiment that uses two independent oscillators OSC-A, OSC-B. The system includes an antenna 217 connected to and providing capacitance to oscillator OSC-A and antenna 218 connected to and providing capacitance to oscillator OSC-B. Each of these oscillators are input to a subtractor and mixer 220 with the output of the subtractor and mixer 220 input to a PLL 222. This PLL 222 is novel in that it is configured as "off center" which means that it is biased in general "trying" to generate an output frequency that is the same as its input frequency but not phase shifted; and at the same time "trying" to also generate the same frequency at its output that is phase shifted by about 90 degrees. This is a novel way of using a PLL integrated circuit (IC) that the inventor believes a PLL has never been used in this way before and that this way of using a PLL is not disclose in the manuals for the Texas Instruments CD4046 PLL. The result is that the output response of the PLL 222 can be delayed just enough to allow the PLL 222 to act as an amplifier and allow for phase difference on its input and output signals to be measured. This is explained in more detail for a particular Texas Instrument's CD4046 PLL with reference to FIGS. 9B and 9C below. The input to the PLL 220 as well as it output are input to a subtractor and mixer 223 that produces a signal that can now be processed to detect motion at one or both of the antennas 217, 218.

In operation, an object 215 may approach an antenna 217 and disturb a capacitance of antenna 217. This will slightly change the frequency that oscillator OSC-A is generating. For example and as illustrated, oscillator OSC-B may be generating a 900 KHz frequency and the movement of the object 215 may cause the frequency generated by oscillator OSC-A to go from 1,000,002 Hz to 1,000,001 Hz. This causes the output of the subtractor and mixer 220 to go from 100,002 Hz to 100,001 Hz. Because the PLL 222 is in the "off center" mode by being configured to try to output both a frequency that follows it input frequency that is both phase shifted 90 degrees and not phase shifted there is a delay in the PLL 222 that can be up to several seconds. The amount of delay can be shorter or longer depending on what is feedback into on the feedback lines. In addition to that, the frequency that is output may be significantly different than the input frequency due to the PLL 222 being operated in a none standard "off center" mode. As discussed, with reference to FIGS. 9B-9C, in the "off center" mode feedback from both a somewhat static/direct current (e.g., DC) phase comparator and a dynamic (e.g., analog) phase comparator are both fed back to the voltage controlled oscillator (VCO) of the PLL 222. Additionally, these two feedbacks are significantly buffered from each other with significant resistance.

In the illustration of FIG. 9A, 100,002 KHz is initially input to the PLL 222 yet only 100 KHz is output. If the PLL 222 where being operate in a conventional mode, the output would be the same as the input or 100,002 Hz. Therefore, initially the subtractor and mixer 223 will subtract 100,002 Hz from 100 KHz and output 2 Hz. Now, when the input to the PLL 220 goes from 100,002 Hz to 100,001 Hz the subtractor and mixer 223 will subtract 100,001 Hz from 100 KHz and output 1 Hz. This is because on can bias the PLL 22 in the "off center" mode to have some delay before its output changes. One of ordinary skill in the art will realize that any appropriate circuit can be used to detect the output going from 2 Hz to 1 Hz and eventually turn that into an alarm signal. For example, a simple RC type of circuit could be used to charge a capacitor to detect that change since a 1 Hz signal will charge a capacitor twice as long as a 2 Hz signal before allowing it to discharge.

Figure 9C:
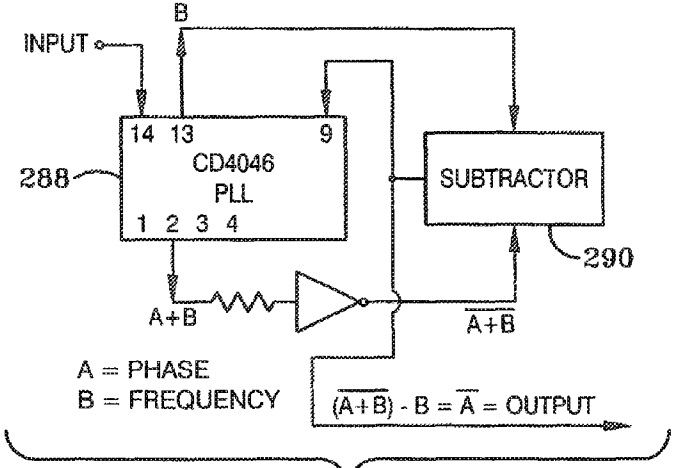
Figure 9B:
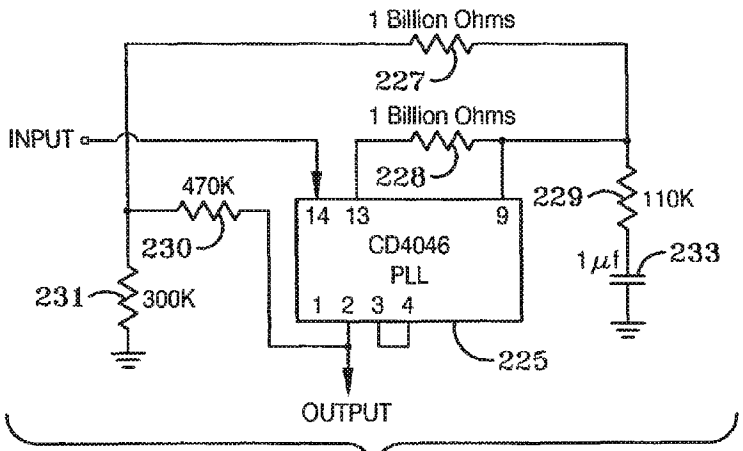

FIG. 9B illustrates one example way to configure the Texas Instrument CD4046 PLL 225 into an "off center" that tries to output a signal that matches the input signal and at the same time tries to output a signal that is the same as the input signal but phase shifted 90 degrees. Pin 14 is the input pin and pin 2 is the output pin. Billion ohm resisters 227, 228 establish a minimum feedback between phase compensator II output (pin 13) and the voltage controlled oscillator (VCO) input (pin 9). The comparator input (pin 3) is wired to the VCO output (pin 4). Resistors 229-231 and capacitor 233 complete the biasing of the PLL 225 into the "off center" mode. Biasing to the "off center" mode means feeding the output from pin 2 that is based on a comparator that rather continuously updates phase changes and the output from pin 13 that periodically updates the phase change and inputting them both into VCO input pin 9. Normal only pin 2 or pin 13 is fed back to VCO input pin 9, not both at the same time. Using both pin 2 and pin 13 as feedback to pin 9 together with using vary larger resistors 227, 228 biases the PLL 225 into the "off center mode".

FIG. 9C illustrates further details about a novel way of using a PLL in a nonconventional way. In this example, changes in frequency are output, however, in other embodiments, frequency, changes in frequency, changes in frequency and phase and the like can be output from the PLL in other configurations of non-conventionally biasing the PLL. Again the DC4046 PLL 288 is used in the example illustration. Phase plus frequency "A+B" is output from pin 2 and phase "B" is output from pin 13. "A+B" inverted to obtain its inverse $\overline{A+B}$. Next, $\overline{A+B}$ and B enter a subtractor 290 where it performs a subtraction to obtain, $\overline{A+B}-B$ which equals $\overline{A}$ which equals frequency.

Figure 10A:
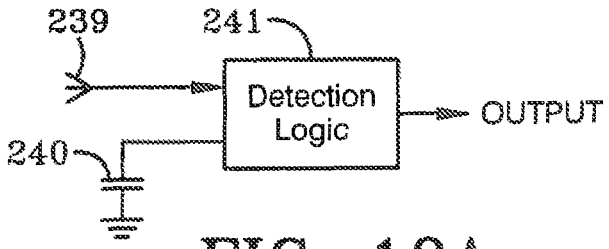
FIGS. 10A-10B illustrate example alarm/motion detection systems that use a single antenna.
Figure 10B:
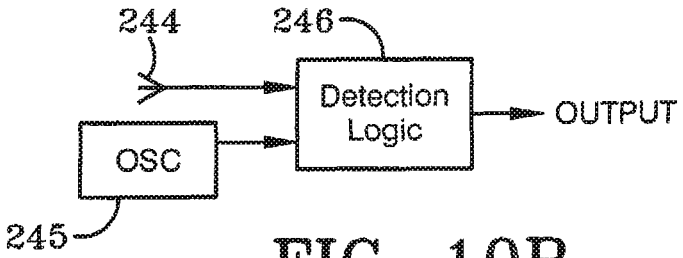

FIGS. 10A and 10B emphasize the point that a single antenna can be used in many embodiments. Of course other embodiments can have two, three or more antennas. FIG. 10A illustrates that an alarm system with two or more antennas can have any unused antennas ground so that only one antenna is used. Here, an example detection logic 241 that may be used to detect motion in ways as discussed can have one of its two antennas grounded with capacitor 240. The detection logic 241 can generate clock pulses as discussed above and using the antenna 240 capacitance 240 and then detect changes in pulse widths/phase to determine when something is approaching the antenna 239.

FIG. 10B includes one antenna 244, an oscillator 245 and a detection logic 246. Here the detection logic 246 can use the capacitance of the antenna 244 to create its own internal oscillator. The detection logic 246 can then compare the steady oscillator 245 to the internal oscillator. When the detection logic 246 determines something changes (phase, frequency, etc.) with respect to the two oscillations, it can determine if this is an alarm and take appropriate action(s).

Figure 11:
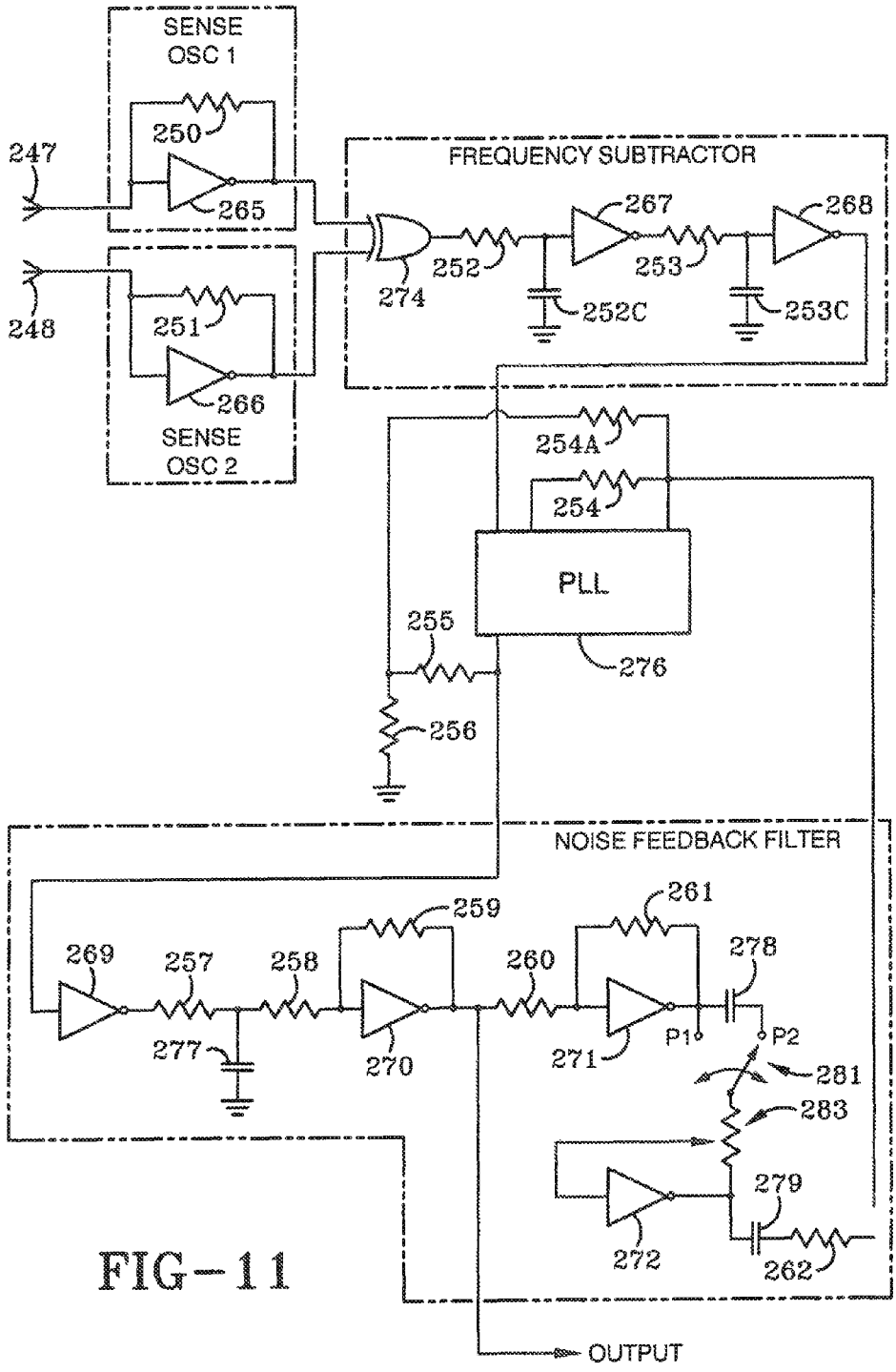
FIG. 11 illustrates an example alarm/motion detection system that is versatile in the number of ways it can be configured to detect motion.

FIG. 11 illustrates an example embodiment with two independent oscillators that illustrates the versatility of sensing a capacitance of an antenna. This embodiment includes an antenna 247 connected to an inverter 265 and a resistor 250 to form a first sense oscillator (sense OSC 1). Similarly, a second antenna 248 is connected to another inverter 266 and a resistor 251 to form a second sense oscillator (sense OSC 2). The outputs of these two oscillators are input to an XOR gate 274 in series with resistors 252, 253 and two inverters 267, 268 that act as a frequency subtractor. The output of the frequency subtractor is input to a PLL 276. As discussed above the PLL 276 is forced to operate in an "off center" mode by resisters 254A and 254-256.

The output of the PLL 276 is optionally feeds into a noise feedback filter. The feedback circuit includes resistors 257262 as well as a variable resistor 283. The feedback circuit also includes capacitors 277-279 and inverters 269-272 as illustrated. It is interesting to note that when each sense oscillator OSC1, OSC2 is generating the same or similar frequencies, that they can become locked together when they are implemented close enough together on a printed circuit board. To prevent this, the sense oscillators OSC1, OSC2 should have a significantly different frequencies.

What makes the motion detection circuit of FIG. 11 unique is that its frequency subtractor can be configured to detect changes in frequency or changes in phase. In general, the PLL 276 can be used to convert changes in frequency to corresponding direct current (DC) value. When the frequency subtractor is used to generate changes in phase instead of frequency, then operational amplifiers are used to convert these changes in phase to corresponding direct current value. The Op amps can be similar to what was discussed above with reference to FIGS. 5A-F. Therefore, this embodiment can detect changes in frequency and convert those changes into a corresponding DC value or it can alternatively be configured to detect changes in phase or the duty cycle of a pulse stream and convert those changes into corresponding DC values.

Figure 12A:
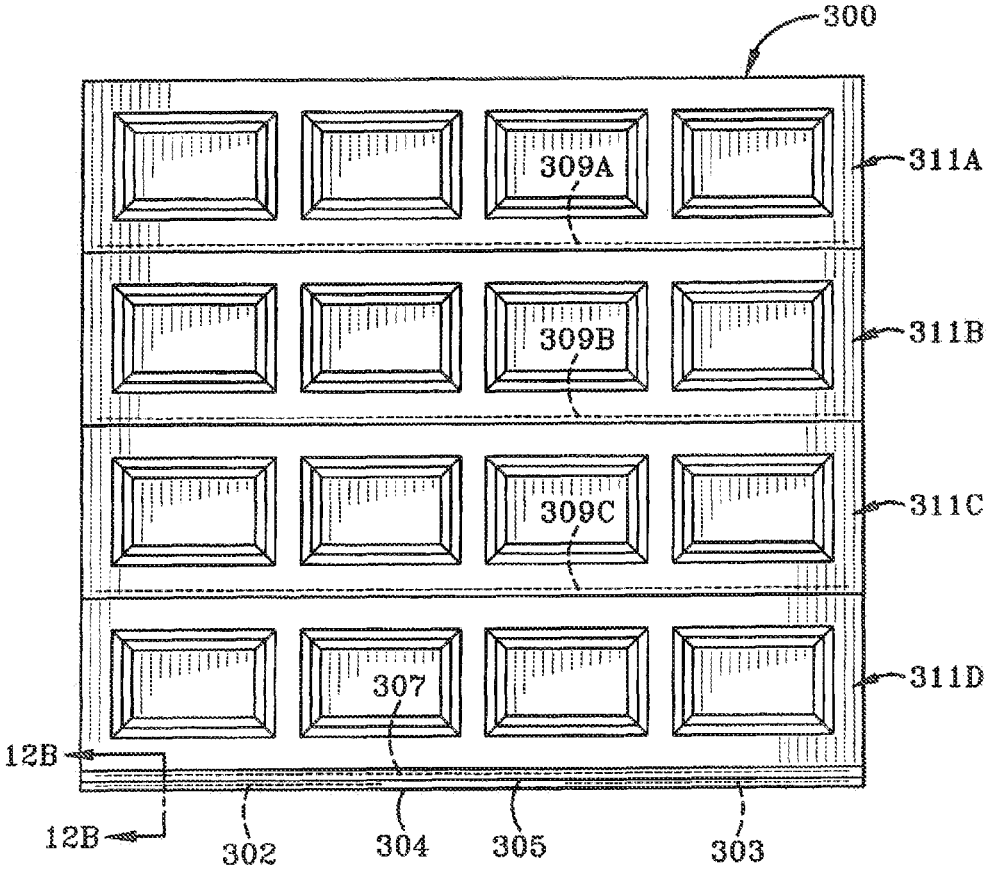
FIGS. 12A and 12B illustrate an example alarm/motion detection system that can detect proximity motion near a garages door, pressure on the bottom of the door and movement near the joints (cracks) between different sections of the door.
Figure 12B:
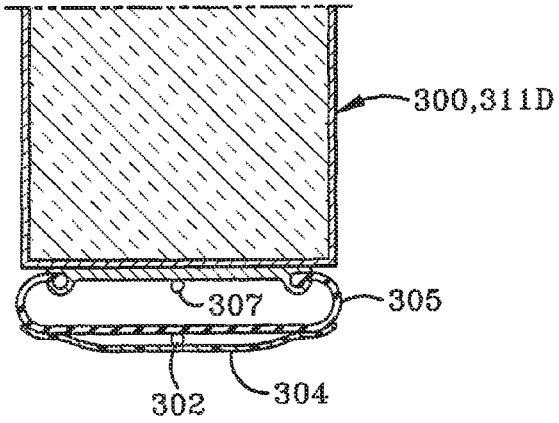

FIGS. 12A and 12B illustrate portions of an example alarm system on a garage door 300. This alarm system has antennas 302, 303 similar to the antennas discussed above attached on the bottom of the garage door 300. The antennas 302, 303 can be covered with some protected material 304 that may be a sheet of material that allows for the propagation of electromagnetic signals from and to the antennas and still physically protects the antennas 302, 303 from becoming damaged from repeated contact with the floor. In some of the embodiments discussed above, the antennas 302, 303 can be wires and the insulation can be the non-conductive insulators that cover the wires. These insulators can be plastic, rubber, or other insulators.

The bottom edge of the garage door 300 can be an insulator 305 that shields the door from the antennas 302, 303 and a bottom sensor 307 can extend along the bottom of the door 300 and the insulator 305 as illustrated. The insulator 305 may be rubber and has a thickness between the range ⅛ inch and one inch, preferably about half an inch but it can be made of other materials and be other thicknesses. The bottom sensor 307 can be an elongated antenna that can be an elongated wire. Rather than be a hollow insulator as illustrated, the insulator may be solid and may for example be formed out of rubber.

Crack sensors 309A-C can be place parallel to bottom (or top) edges of adjacent door sections 311A-D as illustrated. The crack sensors 309A-C are elongated antennas that can be elongated insulated wires. In general the antennas 302, 330, the bottom sensor 307 and the crack sensors 309A-C can each be used as capacitive elements of pulse generators as discussed above. The antennas 302, 303 form part of one pulse generator logic, the bottom sensor 307 can form part of a second pulse generator logic and the crack sensors 309A-C can form part of third pulse generator logic. Detection, amplification and/or other logic as discussed above can then detect when an object moves near and/or touches either the antennas 302, 303, the bottom sensor 307 and/or the crack sensors 309A-C and an appropriate response and/or alarm can be generated. Alternatively, the antennas 302, 303, the bottom sensor 307 and/or the crack sensors 309A-C can all be part of one pulse generation logic, with one detection logic detecting when movement is detected near the antennas 302, 303, or the crack sensors 309A-C or if the bottom sensor 307 is touched. Of course, those with ordinary skill in the art will appreciate that any combination of the antennas 302, 303, the bottom sensor 307 and/or the crack sensors 309A-C can be used with any number of detection logics, amplification logic, alarm logics or other logics.

One or more of the components of the motion detectors/alarm systems discussed above may be manufactured into one or more chips or ASICs. Additionally, an alarm system for detecting motion and generating an appropriate response can be manufactured into one chip or ASIC and the logic for a second or third system and also be manufactured in the same chip or ASIC. Then at time of manufacture (or sales) one or more of the systems can be activated in the chip (or ASIC). For example, the motion alarm system 33 discussed above can be manufactured in to an ASIC together with a separate beam logic that detects when a light beam projected along a bottom end of a garage door opening is blocked. Additionally, a pressure logic can also be implemented within the same ASIC that detects when a pressure on a moving garage door exceeds a threshold. The motion alarm system 33, beam logic and pressure logic can all be part of independent safety systems that operate independent of each other. At the time of manufacture of a garage door safety system, one or more of these independent systems can be activated/used to create a comprehensive garage door safety system.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks that shown and described. Moreover, less than all the illustrated blocks may be required to implement an example methodology. Blocks may be combined or separated into multiple components. Furthermore, additional and/or alternative methodologies can employ additional, not illustrated blocks.

Figure 13:
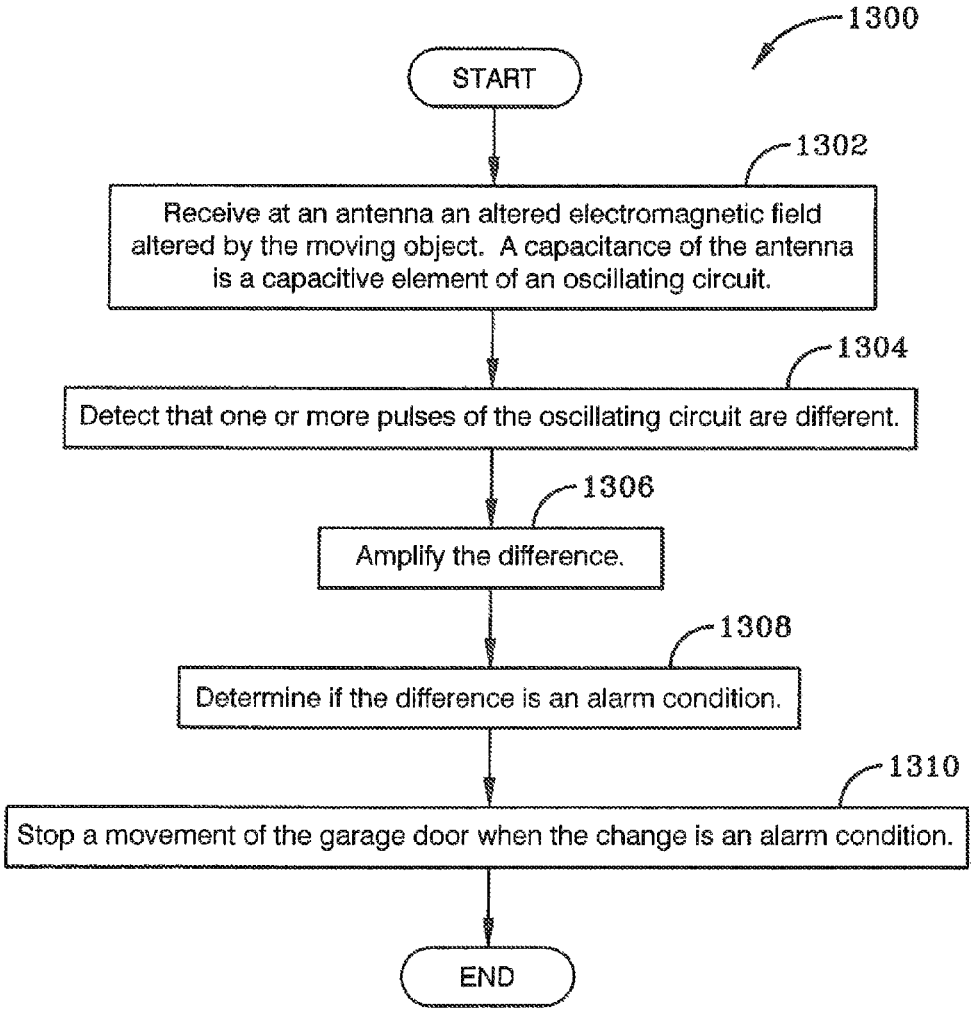
FIG. 13 illustrates an preferred embodiment as a method for detecting motion near a garage door.

FIG. 13 illustrates a method 900 for detecting a moving object moving with respect to a garage door. The method begins, at 1302, by receiving at an antenna an altered electromagnetic field altered by the moving object. The capacitance of the antenna as a capacitive element of an oscillating circuit as described above. One or more pulses of the oscillating circuit are detected as different from prior pulses, at 1304. The difference is amplified, at 1306. A determination is made, at 1308, if the difference is an alarm condition. A movement of the garage door is stopped, at 1310, when the change is an alarm condition.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

What is claimed is:

1. An alarm system configured for controlling a garage door comprising:

a first antenna configured to be mounted to a left end of the garage door;

a second antenna configured to be mounted to a right end of the garage door;

a signal generator logic configured to generate a periodic signal based on a first capacitive value of the first antenna and a second capacitive value of the second antenna, wherein the signal generator logic comprises a first invertor, a second invertor, and a third invertor, and wherein the first antenna is connected between the first invertor and the third invertor, wherein the second antenna is connected between the second invertor and the third invertor, wherein the first invertor, the second invertor, the third invertor, the first antenna and the second antenna form a ring that generates the periodic signal, and wherein the signal generator logic provides transmit power to the first antenna and the second antenna;

detection logic configured to detect a change in a characteristic of the periodic signal caused by movement of an object near the garage door wherein the detection logic is configured to detect the change by comparing a first value based, at least in part, on the first capacitive value of the first antenna and a second value based, at least in part, on the second capacitive value of the second antenna;

amplification logic configured to amplify the change;

alarm detection logic configured to determine if the change is an alarm condition; and alarm response logic configured to stop a movement of the garage door when the change is an alarm condition.

2. The alarm system configured for controlling a garage door of claim 1 wherein the signal generator logic further comprises:

a resistive-capacitive (RC) circuit, wherein the first capacitive value of the first antenna is the capacitive value of the RC circuit.

3. The alarm system configured for controlling a garage door of claim 1 wherein the detection logic further comprises:

a comparing device configured to compare a first oscillating signal output from the first inverter to a second oscillating signal output from the third invertor to detect a phase difference between the first oscillating signal and the second oscillating signal.

4. The alarm system configured for controlling a garage door of claim 3 wherein the comparing device is an exclusive-or (XOR) gate.

5. The alarm system configured for controlling a garage door of claim 4 wherein when an object is near the first antenna a duty cycle of an XOR output of the XOR gate is less than 50 percent and when the object is near the second antenna the duty cycle of the XOR output is more than 50 percent wherein when no object is near the first antenna and no object is near the second antenna the duty cycle of the XOR output is 50 percent.

6. The alarm system configured for controlling a garage door of claim 3 further comprising:

a first resister with a first end and a second end, wherein the first end is connected to an output of the first invertor and the second end is connected to an input of the second invertor;

a second resistor connected between the second invertor and the third invertor; and a third resistor connected between the third invertor and the first invertor.

7. The alarm system configured for controlling a garage door of claim 1 wherein the amplification logic further comprises:

a phased locked loop (PLL) configured as an integration circuit and biased in an off center mode.

8. The alarm system configured or controlling a garage door of claim 1 wherein the amplification logic further comprises:

an operational amplifier (Op Amp).

9. The alarm system configured for controlling a garage door of claim 1 wherein the amplification logic further comprises:

a first Op Amp;

a second Op Amp in series with the first Op Amp, wherein the first Op Amp amplifies the change before the second Op Amp, and wherein when an output of the first Op Amp crosses a threshold the alarm response logic is configured not to stop a movement of the garage door.

10. The alarm system configured for controlling a garage door of claim 1 wherein the change is a phase change.

11. The alarm system configured for controlling a garage door of claim 1 further comprising:

reset logic configured to reset the amplification logic and the alarm detection logic to allow the alarm system to detect a sequence of alarm conditions caused by a movement of an object in proximity to the garage door, wherein the alarm system is configured detect alarm conditions faster when the object approaches the garage door than when the object moves away from the garage door.

12. The alarm system configured for controlling a garage door of claim 11 further comprising:

a radar logic configured to detect at least one of the group of: a speed of the object and a direction of the object;

wherein the detection is based, at least in part, on how fast the reset logic is resetting the amplification logic and the alarm generation logic.

13. The alarm system configured for controlling a garage door of claim 1 further comprising:

a phased locked loop (PLL) that is in an off center mode, wherein the periodic signal that has a change frequency is input to the PLL, and wherein the PLL has an output frequency that is different than the change frequency.

* * * * *